US009328319B2

(12) United States Patent
Ravidat et al.

(10) Patent No.: US 9,328,319 B2
(45) Date of Patent: May 3, 2016

(54) FABRIC CARE COMPOSITION

(71) Applicant: The Procter & Gamble Company, Cincinnati, OH (US)

(72) Inventors: Nans Elian Ravidat, Brussels (BE); Hugo Jean Marie Demeyere, Merchtem (BE); Pieter Jan Maria Saveyn, Heusden (BE)

(73) Assignee: The Procter & Gamble Company, Cincinnati, OH (US)

( * ) Notice: Subject to any disclaimer, the term of this patent is extended or adjusted under 35 U.S.C. 154(b) by 92 days.

(21) Appl. No.: 14/025,870

(22) Filed: Sep. 13, 2013

(65) Prior Publication Data

US 2014/0080749 A1 Mar. 20, 2014

(30) Foreign Application Priority Data

Sep. 14, 2012 (EP) ..... 12184377
Sep. 14, 2012 (EP) ..... 12184483
Dec. 28, 2012 (EP) ..... 12199648

(51) Int. Cl.

| | |
|---|---|
| ***C11D 3/50*** | (2006.01) |
| ***C11D 3/48*** | (2006.01) |
| ***D06M 13/00*** | (2006.01) |
| ***D06M 23/12*** | (2006.01) |
| ***D06M 16/00*** | (2006.01) |
| ***C11D 3/22*** | (2006.01) |
| ***C11D 3/37*** | (2006.01) |
| ***C11D 17/00*** | (2006.01) |

(52) U.S. Cl.

CPC ..... *C11D 3/505* (2013.01); *C11D 3/227* (2013.01); *C11D 3/3773* (2013.01); *C11D 3/3796* (2013.01); *C11D 3/48* (2013.01); *C11D 3/50* (2013.01); *C11D 17/003* (2013.01); *D06M 13/005* (2013.01); *D06M 16/00* (2013.01); *D06M 23/12* (2013.01)

(58) Field of Classification Search

CPC ..... C11D 3/505
USPC ..... 512/4
See application file for complete search history.

(56) References Cited

U.S. PATENT DOCUMENTS

| | | | | |
|---|---|---|---|---|
| 2,954,347 | A | 9/1960 | St. John et al. | |
| 4,022,938 | A | 5/1977 | Zaki et al. | |
| 4,128,484 | A | 12/1978 | Barford et al. | |
| 4,234,627 | A | 11/1980 | Schilling | |
| 4,483,779 | A | 11/1984 | Llenado et al. | |
| 4,483,780 | A | 11/1984 | Llenado | |
| 4,514,461 | A | 4/1985 | Woo | |
| 4,540,721 | A | 9/1985 | Staller | |
| 4,565,647 | A | 1/1986 | Llenado | |
| RE32,713 | E | 7/1988 | Woo | |
| 4,806,266 | A | 2/1989 | Burrill | |
| 4,882,220 | A | 11/1989 | Ono et al. | |
| 4,917,920 | A | 4/1990 | Ono et al. | |
| 4,973,422 | A | 11/1990 | Schmidt | |
| 5,032,391 | A | 7/1991 | Helioff et al. | |
| 5,188,769 | A | 2/1993 | Connor et al. | |
| 5,332,528 | A | 7/1994 | Pan et al. | |
| 5,500,138 | A * | 3/1996 | Bacon | C11D 1/62 510/102 |
| 5,525,588 | A | 6/1996 | Michetti | |
| 5,648,329 | A | 7/1997 | Blake et al. | |
| 5,670,476 | A | 9/1997 | Vogel et al. | |
| 5,707,950 | A | 1/1998 | Kasturi et al. | |
| 5,728,671 | A | 3/1998 | Rohrbaugh et al. | |
| 6,020,303 | A | 2/2000 | Cripe et al. | |
| 6,024,943 | A | 2/2000 | Ness et al. | |
| 6,042,792 | A | 3/2000 | Shefer et al. | |
| 6,051,540 | A | 4/2000 | Shefer et al. | |
| 6,093,856 | A | 7/2000 | Cripe et al. | |
| 6,100,233 | A | 8/2000 | Sivik et al. | |
| 6,150,322 | A | 11/2000 | Singleton et al. | |
| 6,153,577 | A | 11/2000 | Cripe et al. | |
| 6,200,949 | B1 | 3/2001 | Reijmer et al. | |
| 6,482,994 | B2 | 11/2002 | Scheper et al. | |
| 6,531,444 | B1 | 3/2003 | Shefer et al. | |
| 6,551,986 | B1 | 4/2003 | Littig et al. | |
| 6,642,200 | B1 | 11/2003 | Zhang et al. | |
| 6,645,479 | B1 | 11/2003 | Shefer et al. | |
| 6,844,309 | B1 | 1/2005 | Sivik et al. | |

(Continued)

FOREIGN PATENT DOCUMENTS

| | | |
|---|---|---|
| CA | 2 735 761 A1 | 1/2012 |
| EP | 0210731 A2 | 2/1987 |

(Continued)

OTHER PUBLICATIONS

Kolb, B, Application of an automated head-space procedure for trace analysis by gas chromatography, Journal of Chromatography, Elsevier Science Publishers B.V, NL, Jan. 1, 1976, pp. 553-568, vol. 122.

Berglund, L.G. et al., Simulation of the Thermal Effects of Dissolved Materials in Human Sweat, Computers and Biomedical Research, Academic Press, London, GB, Jan. 1, 1973, pp. 127-138, vol. 6.

Normand, V. et al., Modelling perfume deposition on fabric during a washing cycle: theoretical approach, Flavour and Fragrance Journal, 2008, pp. 49-57, vol. 23.

Liu, H. et al., Adsorption of Aroma Chemicals on Cotton Fabric from Aqueous Systems, Journal of Surfactants and Detergents, 2005, pp. 311-317, vol. 8, No. 4.

Ignac, Capek, Degradation of kinetically-stable o/w emulsions, Advances in Colloid and Interface Science, 2004, pp. 125-155, vol. 107.

Extended European Search Report; Application No. 13176784.0-1358; dated Dec. 13, 2013; 7 pages.

(Continued)

*Primary Examiner* — John Hardee

(74) *Attorney, Agent, or Firm* — James F. McBride; Steven W. Miller

(57) ABSTRACT

An aqueous fabric care composition having perfume micro-capsules. The smell provided by the freshly formulated composition and the same composition after storage has a limited character and intensity change. The composition has from about 0 wt % to about 5 wt % of anionic surfactant, from about 0 wt % to about 3 wt % of cationic surfactant, from about 0 wt % to about 3 wt % of a non-ionic surfactant, from about 0.01 wt % to about 15 wt % of perfume micro-capsules and water.

19 Claims, No Drawings

(56) References Cited

U.S. PATENT DOCUMENTS

| | | | | |
|---|---|---|---|---|
| 6,908,962 | B1 | 6/2005 | Frankenbach et al. | |
| 7,491,687 | B2 | 2/2009 | Popplewell et al. | |
| 2002/0040504 | A1 | 4/2002 | DuVal et al. | |
| 2003/0060390 | A1 | 3/2003 | Demeyere et al. | |
| 2003/0125224 | A1 | 7/2003 | Seitz, Jr. et al. | |
| 2003/0158344 | A1 | 8/2003 | Rodriques et al. | |
| 2003/0165692 | A1 | 9/2003 | Koch et al. | |
| 2003/0195133 | A1 | 10/2003 | Shefer et al. | |
| 2003/0203829 | A1 | 10/2003 | Shefer et al. | |
| 2003/0215417 | A1 | 11/2003 | Uchiyama et al. | |
| 2003/0216488 | A1 | 11/2003 | Uchiyama et al. | |
| 2004/0071742 | A1 | 4/2004 | Popplewell et al. | |
| 2004/0071746 | A1 | 4/2004 | Popplewell et al. | |
| 2004/0072719 | A1 | 4/2004 | Bennett et al. | |
| 2004/0072720 | A1 | 4/2004 | Brain et al. | |
| 2004/0087476 | A1 | 5/2004 | Dykstra et al. | |
| 2004/0087477 | A1 | 5/2004 | Ness | |
| 2004/0091445 | A1 | 5/2004 | Dykstra et al. | |
| 2004/0092414 | A1 | 5/2004 | Clapp et al. | |
| 2004/0106536 | A1 | 6/2004 | Mane et al. | |
| 2004/0110648 | A1 | 6/2004 | Jordan, IV et al. | |
| 2004/0253200 | A1* | 12/2004 | Rahman Ansari et al. | 424/76.2 |
| 2006/0252668 | A1* | 11/2006 | Frankenbach | C11D 1/62 510/504 |
| 2007/0149424 | A1 | 6/2007 | Warr et al. | |
| 2007/0275866 | A1 | 11/2007 | Dykstra | |
| 2008/0031961 | A1 | 2/2008 | Cunningham et al. | |
| 2008/0242584 | A1 | 10/2008 | Wahl et al. | |
| 2009/0238787 | A1 | 9/2009 | Finke et al. | |
| 2010/0173816 | A1 | 7/2010 | Wichmann | |
| 2010/0323938 | A1 | 12/2010 | Quellet et al. | |
| 2011/0104221 | A1* | 5/2011 | Galeone et al. | 424/401 |
| 2013/0090282 | A1 | 4/2013 | Blondel | |
| 2013/0203642 | A1 | 8/2013 | Huchel et al. | |
| 2014/0075685 | A1 | 3/2014 | Saveyn et al. | |
| 2014/0075686 | A1 | 3/2014 | Saveyn et al. | |
| 2014/0080749 | A1 | 3/2014 | Ravidat et al. | |
| 2014/0080750 | A1 | 3/2014 | Demeyere et al. | |
| 2014/0080917 | A1 | 3/2014 | Demeyere et al. | |

FOREIGN PATENT DOCUMENTS

| | | | |
|---|---|---|---|
| EP | 0 838 212 | A1 | 4/1998 |
| EP | 1393706 | A1 | 3/2004 |
| EP | 1 685 827 | B1 | 10/2010 |
| WO | WO 92/06162 | A1 | 4/1992 |
| WO | WO 93/19146 | A1 | 9/1993 |
| WO | WO 96/06152 | A2 | 2/1996 |
| WO | WO 00/32735 | A1 | 6/2000 |
| WO | WO 03/061615 | A1 | 7/2003 |

OTHER PUBLICATIONS

International Search Report; International Application No. PCT/US2013/059568; date of mailing Dec. 11, 2013; 5 pages.

International Search Report; International Application No. PCT/US2013/058912; date of mailing Dec. 12, 2013; 5 pages.

International Search Report; International Application No. PCT/US2013/058924; date of mailing Dec. 13, 2013; 4 pages.

International Search Report; International Application No. PCT/US2013/058935; date of mailing Dec. 16, 2013; 5 pages.

Jones, Richard G., et al.; Compendium of Polymer Terminology and Nomenclature; IUPAC Recommendations 2008; International Union of Pure and Applied Chemistry 2009; p. 215; 2nd edition; RSC Publishing Cambridge, UK.

* cited by examiner

FABRIC CARE COMPOSITION

FIELD OF THE INVENTION

The present invention relates to the field of fabric-care compositions comprising perfume micro-capsules.

BACKGROUND OF THE INVENTION

Fabric-care compositions comprising perfume-microcapsule can be used to provide long term freshness to the fabrics. When treating a fabric with a fabric-care composition comprising perfume-microcapsules, the perfume-microcapsules deposit on the fabric. The perfume comprised in the capsules is then released over-time, for example by leakage or breakage of the capsules while the fabric are worn.

The perfume in the microcapsule is typically a complex mixture of perfume raw material carefully designed to provide a balanced smell and a nice perfume character. However it has been noticed that fabric treated with aqueous composition comprising perfume micro-capsules were not exhibiting the same smell character when treated with a fresh composition or with the same composition after several weeks of storage. To avoid a loss of control of the consumer experience, the perfumer has to limit oneself to perfume mixtures which have shown a lower character change over aging of a composition. This affects the flexibility of the perfumer. Also, providing a perfume mixture less sensible to the aging of the composition is typically made at the expense of other perfume benefits such as freshness, longevity, deepness of the smell, or balance of the perfume.

There is thus a need for fabric-care compositions comprising perfume micro-capsules, the variation of perfume character provided to the fabric by the freshly prepared composition and the same composition used after storage being limited.

SUMMARY OF THE INVENTION

According to the present invention, there is provided an aqueous fabric care composition, preferably a rinsing composition, comprising:

a. from 0 wt % to 5 wt % of anionic surfactant,
b. from 0 wt % to 3 wt % of cationic surfactant,
c. from 0 wt % to 3 wt % of a non-ionic surfactant,
d. from 0.01 wt % to 15 wt % of perfume micro-capsules,
e. from 50 wt % to 99.99wt % of water.

The inventors have found that a limited difference of smell character could be observed between fabric treated with the freshly prepared fabric-care compositions of the invention and fabric treated with the same fabric-care composition after storage.

The aqueous fabric care composition may comprise from 0 wt % to 1.5 wt % of anionic surfactant, from 0 wt % to 1.5 wt % of cationic surfactant, from 0 wt % to 2 wt % of a non-ionic surfactant, from 0.02 wt % to 2 wt % of perfume microcapsules, and from 50 wt % to 99.9 wt % of water.

DETAILED DESCRIPTION OF THE INVENTION

All percentages, ratios and proportions used herein are by weight percent of the composition, unless otherwise specified. All average values are calculated "by weight" of the composition or components thereof, unless otherwise expressly indicated.

The Aqueous Fabric Care Composition

The aqueous fabric care composition comprises at least 50% by weight of water, preferably at least 60%, or 70%, or 80%, 90%, 95%, or 97% by weight of water. The composition may comprise from 65% to 99% or from 85% to 98% by weight of water.

The composition is preferably in liquid form. The composition is preferably a rinse-added composition.

The invention also concerns a package comprising the composition of the invention. The package preferably does not comprise a spraying system.

The composition may be comprised in a packaged comprising from 1 ml to 3 l of product, for example from 2 ml to 1 l or from 3 ml to 500 ml or from 5 ml to 100 ml or from 7 ml to 50 ml or from 10 ml to 20 ml.

The package may be a bottle or a sachet. The package may comprise plastic such as polyolefins, polyesters, polyamides, vinyl, polyvinylchloride, acrylic, polycarbonates, polystyrene, and polyurethane. Plastics can include both thermoplastic and/or thermoset. The plastic bottle may comprise PET and/or may comprise from 100 ml to 1.5 l of product, preferably from 300 ml to 1 l . The sachet may comprise from 5 ml to 30 ml of product, preferably from 10 ml to 20 ml.

The Surfactant System

It is preferable that the composition does not comprise or comprises a limited amount of surfactant. The inventors have found out that the perfume character and the perfume intensity provided by the composition of the invention was more stable overtime when the composition of the invention comprise a low level or no surfactant. The composition may comprise from 0% to 5% by weight of surfactant. Preferably the composition comprises less than 3%, or even less than 1%, or even less than 0.5%, or 0.2%, or 0.1% by weight of surfactant. When a surfactant is present, it is preferred that the surfactant is a non-ionic surfactant.

Anionic Surfactant

It is preferable that the composition does not comprise or comprises a limited amount of anionic surfactant. The composition comprises from 0% to 5% by weight of anionic surfactant. Preferably the composition comprises less than 3%, or even less than 1%, or even less than 0.5%, or 0.2%, or 0.1% by weight of anionic surfactant. Preferably, the composition is free or essentially free of anionic surfactants.

The composition may comprise less than 3%, or even less than 1%, or even less than 0.5%, or 0.2%, or 0.1% by weight or may be essentially free of alkyl benzene sulfonic acids and their salts, alkoxylated or non-alkoxylated alkyl sulfate materials, ethoxylated alkyl sulfate surfactants, mid-branched primary alkyl sulfate surfactants, and mixtures thereof.

Cationic Surfactant

It is preferable that the composition of the invention comprises no cationic surfactant or a limited amount of cationic surfactant. The composition comprises from 0% to 3% by weight of cationic surfactant. Preferably the composition comprises less than 2%, or even less than 1% or even less than 0.5%, or less than 0.2%, or less than 0.1% by weight of cationic surfactant. Preferably, the composition is free or essentially free of cationic surfactants.

Cationic surfactants include but are not limited to, quaternary ammonium compounds. Quaternary ammonium compounds may comprise ester quats, amide quats, imidazoline quats, alkyl quats, amdioester quats, and mixtures thereof. Quaternary ammonium compounds may comprise monoalkyquaternary ammonium compound, dialkylquaternary ammonium compound, trialkylquaternary ammonium compound, a diamido quaternary compound, a diester quaternary ammonium compound. Preferably, the composition comprises less than 2.5% by weight, or even less than 1% or even less than 0.5%, or 0.2%, or 0.1% of quaternary ammonium compounds.

Ester quaternary ammonium compounds include, but are not limited to, compounds selected from the group consisting of mono esters of acyl-oxyethyl-N,N-dimethylammonium chloride, diesters of acyl-oxyethyl-N,N-dimethylammonium chloride, triester quats, and mixtures thereof. Amide quats include but are not limited to, materials selected from the group consisting of monoamide quats, diamide quats and mixtures thereof. Alkyl quats include but are not limited to, materials selected from the group consisting of mono alkyl quats, dialkyl quats quats, trialkyl quats, tetraalkyl quats and mixtures thereof.

Other examples of cationic surfactant include, but are not limited to, N,N-bis(stearoyl-oxy-ethyl)N,N-dimethyl ammonium chloride, N,N-bis(tallowoyl-oxy-ethyl)N,N-dimethyl ammonium chloride, N,N-bis(stearoyl-oxy-ethyl)N-(2 hydroxyethyl)N-methyl ammonium methylsulfate, 1,2 di(stearoyl-oxy) 3 trimethyl ammoniumpropane chloride, dialkylenedimethylammonium salts such as dicanoladimethylammonium chloride, di(hard)tallowdimethylammonium chloride, dicanoladimethylammonium methylsulfate, dioleyldimethylammonium chloride available from Witco Corporation under the trade name Adogen® 472, dihardtallow dimethylammonium chloride available from Akzo Nobel Arquad 2HT75, 1-methyl-1-stearoylamidoethyl-2-stearoylimidazolinium methylsulfate available commercially from the Witco Corporation under the trade name Varisoft®, 1-tallowylamidoethyl-2-tallowylimidazoline, ditallowoyloxyethyl dimethyl ammonium chloride, dihydrogenated-tallowoyloxyethyl dimethyl ammonium chloride, ditallow dimethyl ammonium chloride, alkylbenzenedimethyl ammonium chloride, dihydrogenatedtallow dimethyl ammonium chloride, ditallowoyloxyethyl methylhydroxyethylammonium methyl sulfate, dihydrogenated-tallowoyloxyethyl methyl hydroxyethylammonium chloride.

Non-Ionic Surfactant

It is preferable that the composition of the invention comprises no non-ionic surfactant or a limited amount of non-ionic surfactant. The composition comprises from 0% to 3% by weight of non-ionic surfactant. Preferably the composition comprises less than 2%, or even less than 1% or even less than 0.5%, or less than 0.2%, or less than 0.1% by weight of non-ionic surfactant. According to an embodiment of the invention, a low level of surfactant may be needed. In that specific embodiment, it is preferred that the surfactant comprises non-ionic surfactant, for example from 0.05% to 2%, or from 0.1 to 1.5% by weight of non-ionic surfactant.

In the composition of the invention, the weight ratio of (cationic surfactant+anionic surfactant+non-ionic surfactant) to (non-ionic surfactant) is preferably below 10, preferably below 5, for example between 1 and 2, or between 1 and 1.5, or between 1 and 1.2 or between 1 and 1.1.

Non-ionic surfactants, includes alkoxylated fatty alcohols, amine oxide surfactants, sorbitan esters and their derivatives, and mixtures thereof. Preferably, the non-ionic surfactant is liquid at 25° C.

Alkoxylated fatty alcohols are materials which correspond to the general formula: $R_1(C_mH_{2m}O)_nOH$ wherein $R_1$ is a $C_8$-$C_{16}$ alkyl group, m is from 2 to 4, and n ranges from 2 to 120, or from 2 to 12. Preferably $R_1$ is an alkyl group, which may be primary or secondary, that contains from 9 to 15 carbon atoms, more preferably from 10 to 14 carbon atoms. In one embodiment, the alkoxylated fatty alcohols will also be ethoxylated materials that contain from about 2 to 12 ethylene oxide moieties per molecule, more preferably from about 3 to 10 ethylene oxide moieties per molecule.

Alkoxylated fatty alcohol nonionic surfactants have been marketed under the tradename NEODOL® by the Shell Chemical Company.

Amine oxides are materials which are often referred to in the art as "semi-polar" nonionics. Amine oxides have the formula: $R_2(EO)_x(PO)_y(BO)_zN(O)(CH_2R_3)_2.qH_20$. In this formula, $R_2$ is a relatively long-chain hydrocarbyl moiety which can be saturated or unsaturated, linear or branched, and can contain from 8 to 20, preferably from 10 to 16 carbon atoms, and is more preferably $C_{12}$-$C_{16}$ primary alkyl. $R_3$ is a short-chain moiety, preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12}$-$C_{14}$ alkyldimethyl amine oxide.

Sorbitan esters are esterified dehydration products of sorbitol. The preferred sorbitan ester comprises a member selected from the group consisting of $C_{10}$-$C_{26}$ acyl sorbitan monoesters and $C_{10}$-$C_{26}$ acyl sorbitan diesters and ethoxylates of said esters wherein one or more of the unesterified hydroxyl groups in said esters preferably contain from 1 to about 6 oxyethylene units, and mixtures thereof. For the purpose of the present invention, sorbitan esters containing unsaturation (e.g., sorbitan monooleate) can be utilized.

Details, including formula, of the preferred sorbitan esters can be found in U.S. Pat. No. 4,128,484.

Certain derivatives of the preferred sorbitan esters herein, especially the "lower" ethoxylates thereof (i.e., mono-, di-, and tri-esters wherein one or more of the unesterified —OH groups contain one to about twenty oxyethylene moieties are also useful in the composition of the present invention. Therefore, for purposes of the present invention, the term "sorbitan ester" includes such derivatives. An example of a preferred material is Polysobate 61 known as Tween® 61 from ICI America.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid, ester, or acid chloride in a simple esterification reaction.

Other preferred sorbitan esters are disclosed in U.S. Pat. No. 4,022,938.

The composition may comprise a non-ionic surfactant comprising polyglycerol ester.

Non-limiting examples of non-ionic surfactants include: a) $C_{12}$-$C_{18}$ alkyl ethoxylates, such as, NEODOL® nonionic surfactants; b) $C_6$-$C_{12}$ alkyl phenol alkoxylates wherein the alkoxylate units are a mixture of ethyleneoxy and propyleneoxy units; c) $C_{12}$-$C_{18}$ alcohol and $C_6$-$C_{12}$ alkyl phenol condensates with ethylene oxide/propylene oxide block polymers such as PLURONIC® from BASF; d) $C_{14}$-$C_{22}$ mid-chain branched alcohols, BA, as discussed in U.S. Pat. No. 6,150,322; e) $C_{14}$-$C_{22}$ mid-chain branched alkyl alkoxylates, $BAE_x$ wherein x is 1-30, as discussed in U.S. Pat. Nos. 6,153,577; 6,020,303; and 6,093,856; f) alkylpolysaccharides as discussed in U.S. Pat. No. 4,565,647; specifically alkylpolyglycosides as discussed in U.S. Pat. Nos. 4,483,780 and 4,483,779; g) polyhydroxy fatty acid amides as discussed in U.S. Pat. No. 5,332,528; WO 92/06162; WO 93/19146; WO 93/19038; and WO 94/09099; h) ether capped poly(oxyalkylated) alcohol surfactants as discussed in U.S. Pat. No. 6,482,994 and WO 01/42408; i) ethoxylate of sorbitan esters.

Non-ionic surfactants, includes the Abex series from Rhodia Inc., Actrafos series from Georgia Pacific, Acconon series from Abitec Corporation, Adsee series from Witco Corp., Aldo series from Lonza Inc., Amidex series from Chemron Corp., Amodox series from Stepan Company, heterocyclic type products, and many other companies. Preferred non-ionic surfactants include tallow alkyl ethoxylate (such as Genapol T080 or Genapol T680 supplied by Clariant described in U.S. Pat. No. 5,670,476), and Surforic L24-7 from BASF.

The non-ionic surfactant may have an HLB value comprised between 10 and 19.5 or between 11 and 19 or between 12 and 18.5 or between 14 and 18.

Zwitterionic surfactants and amphoteric surfactants which are substantially non-ionic at neutral pH may be considered as non-ionic surfactants for the purpose of the invention. Zwitterionic surfactants and amphoteric surfactants which are substantially cationic or anionic at neutral pH may respectively be considered as cationic or anionic surfactants for the purpose of the invention.

The composition of the invention may comprise no zwitterionic and/or amphoteric surfactant or a limited amount of such surfactant. The composition may comprise from 0% to 3% by weight of zwitterionic and/or amphoteric surfactant. The composition may comprise less than 2%, or even less than 1% or even less than 0.5%, or 0.2%, or 0.1% by weight of zwitterionic and/or amphoteric surfactant. The composition may be free or essentially free of zwitterionic and/or amphoteric surfactants.

The Perfume Micro-Capsule

The composition of the invention comprises from 0.01 to 15% by weight of perfume micro-capsule. The composition of the invention preferably comprises at least 0.02%, preferably at least 0.05% or at least 0.09% or even at least 0.15% by weight of perfume micro-capsules. Typically, the composition of the invention comprises from 0.12% to 10%, or from 0.2% to 5% or from 0.3% to 2% by weight of perfume microcapsules.

Perfume micro-capsules typically comprise a core comprising a perfume, a shell having an inner and outer surface, said shell encapsulating said core. The perfume micro-capsules may comprise at least 30%, or at least 50%, for example at least 70% or 90% by weight of the perfume microcapsule of perfume. The shell may comprise a material selected from the group consisting of polyethylenes; polyamides; polystyrenes; polyisoprenes; polycarbonates; polyesters; polyacrylates; aminoplasts, in one aspect said aminoplast may comprise a polyureas, polyurethane, and/or polyureaurethane, in one aspect said polyurea may comprise polyoxymethyleneurea and/or melamine formaldehyde; polyolefins; polysaccharides, in one aspect said polysaccharide may comprise alginate and/or chitosan; gelatin; shellac; epoxy resins; vinyl polymers; water insoluble inorganics; silicone; and mixtures thereof. Preferably the perfume micro-capsules comprise an aminoplast material, polyamide material and/or an acrylate material, for example a melamine-formaldehyde and/or cross linked melamine formaldehyde or ureaformaldehyde material. Suitable amines include melamine, urea, benzoguanamine, glycoluril, and mixtures thereof. Suitable melamines include, methylol melamine, methylated methylol melamine, imino melamine and mixtures thereof. Suitable ureas include, dimethylol urea, methylated dimethylol urea, urea-resorcinol, and mixtures thereof.

The perfume microcapsule may comprise a cationic, non-ionic and/or anionic deposition aid. The perfume microcapsule may comprise a deposition aid selected from the group consisting of, a cationic polymer, a non-ionic polymer, an anionic polymer and mixtures thereof. The perfume microcapsule may comprise a cationic polymer. The perfume microcapsule may comprise a moisture-activated microcapsule (e.g., cyclodextrin comprising perfume microcapsule).

The perfume micro-capsule may have a particle size of from 1 micron to 80 microns, 5 microns to 60 microns, from 10 microns to 50 microns, or even from 15 microns to 40 microns. The perfume micro-capsule may have a particle wall thickness of from 30 nm to 250 nm, from 80 nm to 180 nm, or even from 100 nm to 160 nm.

Encapsulation techniques can be found in "Microencapsulation: methods and industrial applications" edited by Benita and Simon (marcel Dekker Inc 1996).

Suitable perfume microcapsules include those described in the following references: US 2003215417 A1; US 2003216488 A1; US 2003158344 A1; US 2003165692 A1; US 2004071742 A1; US 2004071746 A1; US 2004072719 A1; US 2004072720 A1; EP 1393706 A1; US 2003203829 A1; US 2003195133 A1; US 2004087477 A1; US 20040106536 A1; US 6645479; U.S. Pat. No. 6,200,949; U.S. Pat. No. 4,882,220; U.S. Pat. No. 4,917,920; U.S. Pat. No. 4,514,461; U.S. RE 32713; U.S. Pat. No. 4,234,627.

The perfume micro-capsule comprises a perfume. Preferably, the perfume of the micro-capsule comprises a mixture of at least 3, or even at least 5, or at least 7 perfume raw material. The perfume of the micro-capsule may comprise at least 10 or at least 15 perfume raw materials.

The inventors have discovered that the compositions of the invention could be particularly effective at lowering the character changes of a perfume when the perfume comprises perfume raw material having different ClogP value. Indeed, when the composition comprises a high level of surfactant, in particular anionic or cationic surfactant, the character of the perfume may drastically change over time if the perfume raw materials have ClogP values that extend on a broad range of values. Lowering the level of surfactant, as taught by the current invention, is thus particularly desirable with that kind of perfume.

The perfume micro-capsule may comprise between 10% and 50% or between 15% and 40% or at between 20% and 30% of perfume raw materials having a ClogP comprised between 1.5 and 3 and comprise between 10% and 50% or between 15% and 40% or at between 20% and 30% of perfume raw materials having a ClogP comprised between 3.5 and 5.

The perfume micro-capsule may comprise between 10% and 50% or between 15% and 40% or at between 20% and 30% of perfume raw materials having a ClogP comprised between 2 and 3 and comprise between 10% and 50% or between 15% and 40% or at between 20% and 30% of perfume raw materials having a ClogP comprised between 3.5 and 4.5.

The perfume micro-capsule may comprise between 10% and 50% or between 15% and 40% or at between 20% and 30% of perfume raw materials having a ClogP comprised between 2.5 and 3 and comprise between 10% and 50% or between 15% and 40% or at between 20% and 30% of perfume raw materials having a ClogP comprised between 4 and 4.5.

To further minimize the perfume character change, it is also possible to choose a perfume comprising perfume raw materials having similar ClogP values, in particular similar and high ClogP values. In that case, the combination of the low level of surfactant and the choice of perfume raw materials having similar ClogP values leads to the lowest changes in perfume character overtime.

The perfume micro-capsule may comprises at least 30%, or at least 50%, or at least 70%, or at least 80%, or at least 90% by weight of perfume raw materials having a ClogP comprised between 2 and 5.

Preferably, the perfume micro-capsule comprises at least 30%, or at least 50%, or at least 70%, or at least 80%, or at least 90% by weight of perfume raw materials having a ClogP comprised between 2.5 and 4.5.

The perfume micro-capsule may comprises at least 30%, or at least 50%, or at least 70%, or at least 80%, or at least 90% by weight of perfume raw materials having a ClogP comprised between 3 and 4.

The perfume micro-capsule may comprises at least 30%, or at least 50%, or at least 70%, or at least 80%, or at least 90% by weight of perfume raw materials having a ClogP comprised between 3 and 6.

The perfume micro-capsule may comprises at least 30%, or at least 50%, or at least 70%, or at least 80%, or at least 90% by weight of perfume raw materials having a ClogP comprised between 3.5 and 5.5.

The perfume micro-capsule may comprises at least 30%, or at least 50%, or at least 70%, or at least 80%, or at least 90% by weight of perfume raw materials having a ClogP comprised between 4 and 5.

The perfume micro-capsule may comprises at least 30%, or at least 50%, or at least 70%, or at least 80%, or at least 90% by weight of perfume raw materials having a ClogP comprised between 2 and 4.

The perfume micro-capsule may comprises at least 30%, or at least 50%, or at least 70%, or at least 80%, or at least 90% by weight of perfume raw materials having a ClogP comprised between 2.5 and 3.5.

The perfume micro-capsule may comprises at least 30%, or at least 50%, or at least 70%, or at least 80%, or at least 90% by weight of perfume raw materials having a ClogP comprised between 4 and 6.

ClogP refers to the octanol/water partitioning coefficient (P) of perfume raw materials. The octanol/water partitioning coefficient of a perfume raw material is the ratio between its equilibrium concentrations in octanol and in water. The partitioning coefficients of perfume ingredients are more conveniently given in the form of their logarithm to the base 10, log P. The log P of many perfume ingredients has been reported; for example, the Pomona92 database, available from Daylight Chemical Information Systems, Inc. (Daylight CIS), Irvine, Calif., contains many, along with citations to the original literature. The ClogP values reported herein are most conveniently calculated by the "CLOGP" program available within the Chemoffice Ultra Software version 9 available from CambridgeSoft Corporation, 100 CambridgePark Drive, Cambridge, Mass. 02140 USA or CambridgeSoft Corporation, 8 Signet Court, Swanns Road, Cambridge CB5 8LA UK. The ClogP values are preferably used instead of the experimental log P values in the selection of perfume raw materials which are useful in the present invention.

Preferably the weight ratio of surfactant to perfume micro-capsule is below 30, preferably below 10, preferably below 5, for example below 2, or 1, or 0.5, or 0.2, or 0.1. For example the weight ratio of surfactant to perfume micro-capsule is between 0.15 and 20, for example between 0.30 and 3.

Preferably the weight ratio of cationic surfactant to perfume micro-capsule is below 30, preferably below 10, preferably below 5, for example below 2, or 1, or 0.5, or 0.2, or 0.1. For example the weight ratio of cationic surfactant to perfume micro-capsule is between 0.15 and 20, for example between 0.30 and 3.

Preferably the weight ratio of anionic surfactant to perfume micro-capsule is below 30, preferably below 10, preferably below 5, for example below 2, or 1, or 0.5, or 0.2, or 0.1. For example the weight ratio of anionic surfactant to perfume micro-capsule is between 0.15 and 20, for example between 0.30 and 3.

Preferably the weight ratio of non-ionic surfactant to perfume micro-capsule is below 30, preferably below 10, preferably below 5, for example below 2, or 1, or 0.5, or 0.2, or 0.1. For example the weight ratio of non-ionic surfactant to perfume micro-capsule is between 0.15 and 20, for example between 0.30 and 3.

The Suds Suppressor Technology

The aqueous fabric care composition may comprise a suds suppressor technology for example present at a level of from 0.01% to 15% by weight. Preferably the composition comprises at least 0.02%, or 0.05%, or even at least 0.1% by weight of a suds suppressor technology. The composition may comprise less than from 5%, or less than 3%, or even less than 1% by weight of a suds suppressor technology.

The suds suppressor technology may comprise any known antifoam compound, including highly crystalline waxes and/or hydrogenated fatty acids, silicones, silicone/silica mixtures, lower 2-alkyl alkanols, fatty acids, and mixtures thereof.

The lower 2-alkyl alkanol may be 2-methyl-butanol.

The fatty acid may be a $C_{12}$-$C_{18}$ saturated and/or unsaturated, linear and/or branched, fatty acid, and is preferably a mixture of such fatty acids. A preferred mixture of fatty acids is a mixtures of saturated and unsaturated fatty acids, for example a mixture of rape seed-derived fatty acid and $C_{16}$-$C_{18}$ topped whole cut fatty acids, or a mixture of rape seed-derived fatty acid and a tallow alcohol derived fatty acid, palmitic, oleic, fatty alkylsuccinic acids, and mixtures thereof. The fatty acids may be branched and of synthetic or natural origin, especially biodegradable branched types. Monocarboxylic fatty acids and soluble salts thereof, are described in U.S. Pat. No. 2,954,347.

Examples of silicones, and silica-silicone mixtures are disclosed in U.S. Pat. Nos. 5,707,950 and 5,728,671.

Examples of mixture of antifoam compounds are commercially available from companies such as Dow Corning.

Preferably, the suds suppressor technology comprises a silicone-based compound. Silicone based suds suppressor technology is described in (US 2003/0060390 A1, 65-77). Preferably, the composition comprises from 0.01 to 3% of a silicone-based compound. Less than 3% of a silicone based compound is typically enough to provide the desired rinsing properties. Preferably, the silicone based compound comprises polydimethylsiloxane. The silicone based antifoam compounds may comprise silica and siloxane, for example a polydimethylsiloxane having trimethylsilyl end blocking units. Examples of particulate suds suppressor technologies are described in EP-A-0210731. Examples of particulate suds suppressor technologies in particulate form are described in EP-A-0210721. The inventors have discovered that the suds suppressor technology comprising a silicone-based compound were particularly suitable in the aqueous fabric care composition of the invention.

The aqueous fabric care composition may have a weight ratio of (Suds suppressor technology) to (Non-ionic surfactant) between 0.02 and 8 or between 0.05 and 4 preferably between 0.1 and 2 or between 0.2 and 1.

The aqueous fabric care composition may have a weight ratio of (suds suppressor technology) to (non-ionic surfactant +cationic surfactant +nionic surfactant) between 0.02 and 8 or between 0.05 and 4 preferably between 0.1 and 2 or between 0.2 and 1.

The aqueous fabric care composition may have a weight ratio of (suds suppressor technology) to (suds suppressor technology +cationic surfactant +anionic surfactant) below 20, preferably below 10, for example between 1 and 3, or between 1 and 1.5 or between 1 and 1.2 or between 1 and 1.1.

Perfume

In addition to the perfume micro-capsules, the composition may comprise one or more perfume delivery systems. The additional perfume delivery system may comprise free perfume, pro-perfumes, and mixtures thereof.

To fight the malodour associated with damp fabric, it may be particularly effective that the perfume delivery system comprises free perfume.

The composition may comprise from 0.01% to 10%, or from 0.1% to 5%, or even from 0.2% to 2% by weight of free perfume. The composition may comprise at least 0.75% or at least 1% by weight of free perfume.

Preferably, the free perfume comprises a mixture of at least 3, or even at least 5, or at least 7, or at least 10, or at least 15 perfume raw materials.

Preferably, the perfume composition comprises at least 25% per weight, in particular at least 35%, or at least 50%, or at least 70%, or at least 90%, for example from 65% to 100%, or from 95% to 99.9% per weight of perfume raw material selected from: Lavandin Grosso oil; Iso Propyl-2-Methyl Butyrate; Dimethyl cyclohexenyl 3-butenyl ketone; Eucalyptol; Benzyl Acetate; Hexyl Acetate; Methyl Benzoate; 3a,4,5,6,7,7a-hexahydro-4,7-methano-1H-indenyl acetate; Octanal; Cis-3 hexen-1-ol; Nonanal; Ethyl-2-methyl Butyrate; (Z,E)-2,4-dimethyl cyclohex-3-ene-1-carbaldehyde, Tetrahydro-4-methyl-2-(2-methyl propenyl)-2H-pyran; Geraniol; Iso propylbutanal; 2-pentylcyclopentan-1-ol; Dodecenal; d-limonene; Allyl Caproate; Decenal; Tetra Hydro Linalool; (E)-1-trimethyl-1-cyclohex-3(2,6,6-enyl) but-2-en-1-one; 2,4,6-trimethyl-3-cyclohexene-1-carboxaldehyde; Ionone Beta; Prenyl Acetate; 3-(4-tert-butylphenyl) propanal; 1 Carvone; Allyl Cyclohexyl Propionate; Linalool; Phenyl ethyl alcohol; Lemon Oil; Eugenol; Ethyl Vanillin; Cis-3-Hexenyl Acetate; Diphenyl Oxyde; Ionone Alpha; prop-2-enyl 2-cyclohexyloxyacetate; 2-pentyl-Cyclopentanone; Ethyl-2-methyl Pentanoate; [(4Z)-1-cyclooct-4-enyl]methyl carbonate; Cedryl Acetate; Cinnamic Alcohol; 2-methoxyethylbenzene; Phenyl Ethyl Phenyl Acetate; Citronellol; 2-tert-butyl cyclohexyl acetate; Citral; 3alpha,4,5,6,7,7alpha-hexahydro-4,7-methano-1H-inden-6-ylpropanoate; Iso-bornyl iso-butyrate; and mixture thereof.

Preferably, the perfume composition comprises at least 25% per weight, in particular at least 35%, or at least 50%, or at least 70%, or at least 90%, for example from 65% to 100% per weight of perfume raw material selected from Lavandin Grosso oil; Iso Propyl-2-Methyl Butyrate; Dimethyl cyclohexenyl 3-butenyl ketone; Eucalyptol; Benzyl Acetate; Hexyl Acetate; Methyl Benzoate; 3a,4,5,6,7,7a-hexahydro-4,7-methano-1H-indenyl acetate; Octanal; Cis-3 hexen-1-ol; Nonanal; Ethyl-2-methyl Butyrate; (Z,E)-2,4-dimethyl cyclohex-3-ene-1-carbaldehyde, Tetrahydro-4-methyl-2-(2-methyl propenyl)-2H-pyran; Geraniol; Iso propylbutanal; 2-pentylcyclopentan-1-ol; Dodecenal; d-limonene; Allyl Caproate; Decenal; Tetra Hydro Linalool; (E)-1-trimethyl-1-cyclohex-3(2,6,6-enyl)but-2-en-1-one; 2,4,6-trimethyl-3-cyclohexene-1-carboxaldehyde; Ionone Beta; Prenyl Acetate; 3-(4-tert-butylphenyl)propanal; 1 Carvone; Allyl Cyclohexyl Propionate; Linalool; Phenyl ethyl alcohol; Lemon Oil; Eugenol; Ethyl Vanillin; Cis-3-Hexenyl Acetate; Diphenyl Oxyde; Ionone Alpha; and mixture thereof.

The inventors have surprisingly discovered it could be particularly effective in the composition of the invention to use a perfume composition comprising perfume raw material selected as disclosed in the two previous paragraphs. They have found that the use of such perfume raw materials could make it unnecessary to use a cationic surfactant in order to limit the malodour development on damp fabric.

Dimethyl cyclohexenyl 3-butenyl ketone is available under the name Neobutenone alpha®, galbascone®, dynascone® or galbanum ketone®. 3a,4,5,6,7,7a-hexahydro-4,7-methano-1H-indenyl acetate is also known as Flor Acetate or cyclacet®. Octanal is also known as Octyl Aldehyde. Cis-3 hexen-1-ol is also known as Beta Gamma Hexenol. Nonanal is also known as Nonyl Aldehyde. (Z,E)-2,4-dimethyl cyclohex-3-ene-1-carbaldehyde is also known as Ligustral® or triplal® or Cyclal®. Tetrahydro-4-methyl-2-(2-methyl propenyl)-2H-pyran is also known as Rose Oxide. Iso propylbutanal is also known as florhydral®. 2-pentylcyclopentan-1-ol is also known as Cyclopentol®. Dodecenal is also kown as Lauric Aldehyde. D-limonene is also known as Orange Terpenes. Allyl Caproate is also known as allyl hexanoate. Decenal is also known as Decyl Aldehyde. (E)-1-trimethyl-1-cyclohex-3(2,6,6-enyl)but-2-en-1-one is also known as Delta Damascone. 2,4,6-trimethyl-3-cyclohexene-1-carboxaldehyde is also known as Cyclo Citral. 3-(4-tert-butylphenyl) propanal is also known as Bourgeonal®. Prop-2-enyl 2-cyclohexyloxyacetate is also known as Cyclo Galbanate®. 2-pentyl-Cyclopentanone is also known as Delphone®. Ethyl-2-methyl Pentanoate is also known as Manzanate®. [(4Z)-1-cyclooct-4-enyl] methyl carbonate is also known as Viola°. 2-methoxyethylbenzene is also known as Keone or Pandanol. 2-tert-butyl cyclohexyl acetate is also known as Verdox. 3alpha,4,5,6,7,7alpha-hexahydro-4,7-methano-1H-inden-6-yl propanoate is also known as Cyclaprop or Frutene. Iso-bornyl iso-butyrate is also known as Abierate®.

Viscosity and Polymeric Thickener

Preferably, the aqueous fabric care composition of the invention has a Brookfield viscosity at 60 rpm at 21° C. above 20 cp, preferably above 30 cp or above 50 cp or even above 80 cp, or 120 cp. The aqueous fabric care composition of the invention may have a Brookfield viscosity at 60 rpm at 21° C. comprised between 25 cp and 1000 cp, or between 40 cp and 500 cp, or between 60 cp and 300 cp.

The viscosity may be measured with of a Brookfield viscometer DV-II.

The composition may comprise from 0.01% to 15%, from 0.05 to 5%, or from 0.15% to 3% by weight of a polymeric thickener. Suitable polymeric thickeners are disclosed in, for example, USPA Ser. No. 12/080,358.

The polymeric thickener may be a cationic or amphoteric polymer. The polymeric thickener may be a cationic polymer. The cationic polymer may comprise a cationic acrylate such as Rheovis CDE™. The cationic polymer may have a cationic charge density of from 0.005 to 23, from 0.01 to 12, or from 0.1 to 7 milliequivalents/g, at the pH of intended use of the composition. For amine-containing polymers, wherein the charge density depends on the pH of the composition, charge density is measured at the intended use pH of the product. Such pH will generally range from 2 to 11, more generally from 2.5 to 9.5. Charge density is calculated by dividing the number of net charges per repeating unit by the molecular weight of the repeating unit. The positive charges may be located on the backbone of the polymers and/or the side chains of polymers.

One group of suitable cationic polymers includes those produced by polymerization of ethylenically unsaturated monomers using a suitable initiator or catalyst, such as those disclosed in U.S. Pat. No. 6,642,200.

Suitable polymers may be selected from the group consisting of cationic or amphoteric polysaccharide, polyethylene imine and its derivatives, and a synthetic polymer made by polymerizing one or more cationic monomers selected from the group consisting of N,N-dialkylaminoalkyl acrylate, N,N-dialkylaminoalkyl methacrylate, N,N-dialkylaminoalkyl acrylamide, N,N-dialkylaminoalkylmethacrylamide, quaternized N,N dialkylaminoalkyl acrylate quaternized N,N-dialkylaminoalkyl methacrylate, quaternized N,N-dialkylaminoalkyl acrylamide, quaternized N,N-dialkylaminoalkylmethacrylamide, Methacryloamidopropyl-pentamethyl-1,3-propylene-2-ol-ammonium dichloride, N,N,N,N',N',N",N"-heptamethyl-N"-3-(1-oxo-2-methyl-2-propenyl) aminopropyl-9-oxo-8-azo-decane-1,4,10-triammonium trichloride, vinylamine and its derivatives, allylamine and its derivatives, vinyl imidazole, quaternized vinyl imidazole and diallyl dialkyl ammonium chloride and combinations thereof, and optionally a second monomer selected from the group consisting of acrylamide, N,N-dialkyl acrylamide, methacrylamide, N,N-dialkylmethacrylamide, $C_1$-$C_{12}$ alkyl acrylate, $C_1$-$C_{12}$ hydroxyalkyl acrylate, polyalkylene glyol acrylate, $C_1$-$C_{12}$ alkyl methacrylate, $C_1$-$C_{12}$ hydroxyalkyl methacrylate, polyalkylene glycol methacrylate, vinyl acetate, vinyl alcohol, vinyl formamide, vinyl acetamide, vinyl alkyl ether, vinyl pyridine, vinyl pyrrolidone, vinyl imidazole, vinyl caprolactam, and derivatives, acrylic acid, methacrylic acid, maleic acid, vinyl sulfonic acid, styrene sulfonic acid, acrylamidopropylmethane sulfonic acid (AMPS) and their salts. The polymer may optionally be branched or cross-linked by using branching and crosslinking monomers. Branching and crosslinking monomers include ethylene glycoldiacrylate divinylbenzene, and butadiene. A suitable polyethyleneinine useful herein is that sold under the tradename Lupasol® by BASF, AG, Lugwigschaefen, Germany The aqueous fabric care composition may comprise an amphoteric polymeric thickener polymer. The polymer preferably possesses a net positive charge. Said polymer may have a cationic charge density of 0.05 to 18 milliequivalents/g.

The polymeric thickener may be selected from the group consisting of cationic polysaccharide, polyethylene imine and its derivatives, poly(acrylamide-co-diallyldimethylammonium chloride), poly(acrylamide-methacrylamidopropyltrimethyl ammonium chloride), poly(acrylamide-co-N,N-dimethyl aminoethyl acrylate) and its quaternized derivatives, poly(acrylamide-co-N,N-dimethyl aminoethyl methacrylate) and its quaternized derivative, poly(hydroxyethylacrylate-co-dimethyl aminoethyl methacrylate), poly (hydroxpropylacrylate-co-dimethyl aminoethyl methacrylate), poly(hydroxpropylacrylate-co-methacrylamidopropyltrimethylammonium chloride), poly (acrylamide-co-diallyldimethylammonium chloride-co-acrylic acid), poly(acrylamide-methacrylamidopropyltrimethyl ammonium chloride-co-acrylic acid), poly(diallyldimethyl ammonium chloride), poly(vinylpyrrolidone-co-dimethylaminoethyl methacrylate), poly(ethyl methacrylate-co-quaternized dimethylaminoethyl methacrylate), poly(ethyl methacrylate-co-oleyl methacrylate-co-diethylaminoethyl methacrylate), poly(diallyldimethylammonium chloride-co-acrylic acid), poly(vinyl pyrrolidone-co-quaternized vinyl imidazole) and poly (acrylamide-co-Methacryloamidopropyl-pentamethyl-1,3-propylene-2-ol-ammonium dichloride), Suitable polymeric thickeners include Polyquaternium-1, Polyquaternium-5, Polyquaternium-6, Polyquaternium-7, Polyquaternium-8, Polyquaternium-11, Polyquaternium-14, Polyquaternium-22, Polyquaternium-28, Polyquaternium-30, Polyquaternium-32 and Polyquaternium-33, as named under the International Nomenclature for Cosmetic Ingredients.

The polymeric thickener may comprise polyethyleneimine or a polyethyleneimine derivative. The polymeric thickener may comprise a cationic acrylic based polymer. The polymeric thickener may comprise a cationic polyacrylamide. The polymeric thickener may comprise a polymer comprising polyacrylamide and polymethacrylamidoproply trimethylammonium cation. The polymeric thickener may comprise poly(acrylamide-N-dimethyl aminoethyl acrylate) and its quaternized derivatives. The polymeric thickener may be that sold under the tradename Sedipur®, available from BTC Specialty Chemicals, a BASF Group, Florham Park, N.J. The polymeric thickener may comprise poly(acrylamide-co-methacrylamidopropyltrimethyl ammonium chloride). The polymeric thickener may comprise a non-acrylamide based polymer, such as that sold under the tradename Rheovis® CDE, available from Ciba Specialty Chemicals, a BASF group, Florham Park, N.J., or as disclosed in USPA 2006/0252668.

The polymeric thickener may be selected from the group consisting of cationic or amphoteric polysaccharides. The polymeric thickener may be selected from the group consisting of cationic and amphoteric cellulose ethers, cationic or amphoteric galactomanan, cationic guar gum, cationic or amphoteric starch, and combinations thereof.

The polymeric thickener may be selected from cationic polymers such as alkylamine-epichlorohydrin polymers which are reaction products of amines and oligoamines with epicholorohydrin, for example, those polymers listed in, for example, U.S. Pat. Nos. 6,642,200 and 6,551,986. Examples include dimethylamine-epichlorohydrin-ethylenediamine, available under the trade name Cartafix® CB and Cartafix® TSF from Clariant, Basle, Switzerland.

The polymeric thickener may be selected from cationic polymers such as polyamidoamine-epichlorohydrin (PAE) resins of polyalkylenepolyamine with polycarboxylic acid. The most common PAE resins are the condensation products of diethylenetriamine with adipic acid followed by a subsequent reaction with epichlorohydrin. They are available from Hercules Inc. of Wilmington Del. under the trade name Kymene™ or from BASF AG (Ludwigshafen, Germany) under the trade name Luresin™.

The cationic polymers may contain charge neutralizing anions such that the overall polymer is neutral under ambient conditions. Non-limiting examples of suitable counter ions (in addition to anionic species generated during use) include chloride, bromide, sulfate, methylsulfate, sulfonate, methylsulfonate, carbonate, bicarbonate, formate, acetate, citrate, nitrate, and mixtures thereof.

The cationic polymeric thickener may be obtained by polymerisation of a cationic monomer and a monomer with hydrophobic nature and a non-ionic monomer. In particular, the cationic polymeric thickener may be as disclosed in WO2011/148110. The cationic polymeric thickener may be supplied by SNF.

The weight-average molecular weight of the polymer may be from 500 to 5,000,000, or from 1,000 to 2,000,000, or from 2,500 to 1,500,000 Daltons, as determined by size exclusion chromatography relative to polyethyleneoxide standards with RI detection. In one aspect, the MW of the cationic polymer may be from about 500 to about 37,500 Daltons.

Preferably the weight ratio of surfactant to polymeric thickener is below 30, preferably below 10, for example below 5. For example the weight ratio of surfactant to polymeric thickener is between 0.8 and 20.

Preferably the weight ratio of anionic surfactant to polymeric thickener is below 30, preferably below 10, for example below 5. For example the weight ratio of anionic surfactant to polymeric thickener is between 0.8 and 20.

Preferably the weight ratio of cationic surfactant to polymeric thickener is below 30, preferably below 10, for example below 5. For example the weight ratio of cationic surfactant to polymeric thickener is between 0.8 and 20.

Preferably the weight ratio of non-ionic surfactant to polymeric thickener is below 30, preferably below 10, for example below 5. For example the weight ratio of non-ionic surfactant to polymeric thickener is between 0.8 and 20.

The Antibacterial Compound

The composition of the invention may comprise from 0.01% to 15% of an antibacterial compound, in particular of a non-ionic antibacterial compound having a ClogP above 2.

ClogP refers to the octanol/water partitioning coefficient (P) of a compound such as perfume raw materials or antibacterial compounds. The octanol/water partitioning coefficient of a compound is the ratio between its equilibrium concentrations in octanol and in water. The partitioning coefficients of the compounds are more conveniently given in the form of their logarithm to the base 10, log P. The log P of many compounds has been reported; for example, the Pomona92 database, available from Daylight Chemical Information Systems, Inc. (Daylight CIS), Irvine, Calif., contains many, along with citations to the original literature. The ClogP values reported herein are most conveniently calculated by the "CLOGP" program available within the Chemoffice Ultra Software version 9 available from CambridgeSoft Corporation, 100 CambridgePark Drive, Cambridge, Mass. 02140 USA or CambridgeSoft Corporation, 8 Signet Court, Swanns Road, Cambridge CB5 8LA UK. The ClogP values are preferably used instead of the experimental log P values in the selection of perfume raw materials or antibacterial compound which are useful in the present invention.

Preferably, the composition comprises from 0.02% to 5%, or from 0.05% to 2% or from 0.1% to 1% of a non-ionic antibacterial compound having a ClogP above 2. The composition may comprise from 0.01% to 15%, or from 0.02% to 5%, or from 0.05% to 2% or from 0.1% to 1% of a non-ionic antibacterial compound having a ClogP above 2.5. The composition may comprise from 0.01% to 15%, or from 0.02% to 5%, or from 0.05% to 2% or from 0.1% to 1% of a non-ionic antibacterial compound having a ClogP above 3. The composition may comprise from 0.01% to 15%, or from 0.02% to 5%, or from 0.05% to 2% or from 0.1% to 1% of a non-ionic antibacterial compound having a ClogP above 3.5. The composition may comprise from 0.01% to 15%, or from 0.02% to 5%, or from 0.05% to 2% or from 0.1% to 1% of a non-ionic antibacterial compound having a ClogP above 4. The composition may comprise from 0% to 0.3%, or from 0% to 0.1% or from 0% to 0.05% of an antibacterial compound having a ClogP below 2. The composition may comprise from 0% to 0.3%, or from 0% to 0.1%, or from 0% to 0.05% or from 0% to 0.02% of an antibacterial compound having a ClogP below 1.

The non-ionic antibacterial compound having a ClogP above 2 may be selected from anilides antibacterial compounds, such as triclocarban; biguanides antibacterial compounds, such as chlorhexidine; phenolics antibacterial compounds, such as p-chloro-m-xylenol, butylated hydroxyl toluene, or butylated hydroxyl anisole; triclosan; diclosan; or mixtures thereof. A preferred antibacterial compound is Diclosan.

Triclocarban has a ClogP of 4.93 and is known under the name Preventol SB and can be supplied Lanxess.

Chlorhexidine is sold under the name Hibiclens by MOlnlycke Health Care AB and has a ClogP value of 4.51.

P-chloro-m-xylenol (PCMX) is sold by Netchem Inc Canada and has a ClogP of 3.377.

Butylated hydroxyl toluene or BHT-Ionol CP is available from Ashland Chemical Co and has a ClogP value of 5.27.

Butylated hydroxyl anisole or BHA is available from Ashland Chemical Co and has a ClogP value of 3.06.

Triclosan is sold by BASF and has a ClogP of 4.98.

Diclosan is sold under the trademark name Tinosan®HP100, supplied by BASF and has a ClogP of 4.38.

Preferably, the antibacterial compound is not a perfume. This allows better flexibility to the perfumers who are not bound to the smell of the antibacterial compound to design their perfume around.

In particular the odour detection threshold of the antibacterial compound may be above 100, or even 1000, or even 10.000 or 100.000 or 1.000.000, or even 10.000.000 part per billion (1.000.000.000). The odour detection threshold is defined as the lowest vapour concentration of that material which can be olfactorily detected. The odour detection threshold and some odour detection values are discussed in discussed in eg "Standardized Human Olfactory Thresholds", M. Devos et al, IRL Press at Oxford University Press, 1990, and "Compilation of Odor and Taste Threshold Values Data", F. A. Fazzalar, editor ASTM Data Series DS 48A, American Society for Testing and Materials, 1978.

The antibacterial compound may have a boiling point above 300° C. or even above 450° C. or above 600° C. or even above 700° C.

The weight ratio of polymeric thickener to non-ionic antibacterial compound, in particular to non-ionic antibacterial compound having a ClogP above 2, in the composition of the invention is preferably between 1 and 100, or between 2 and 50 or between 4 and 30 or between 6 and 20.

The weight ratio of non-ionic antibacterial compound having a ClogP above 2 to the total amount of antibacterial compound in the composition of the invention is preferably above 0.5 preferably above 0.6 or 0.75, for example between 0.9 and 1.

The weight ratio of non-ionic antibacterial compound having a ClogP above 3 to the total amount of antibacterial compound in the composition of the invention is preferably above 0.5 preferably above 0.6 or 0.75, for example between 0.9 and 1.

Preferably the weight ratio of surfactant to non-ionic antibacterial compound having a ClogP above 2 is below 300, preferably below 100 preferably below 30, for example below 10, or 5. For example the weight ratio of surfactant to non-ionic antibacterial compound having a ClogP above −2 is between 8 and 200, for example between 20 and 80.

Preferably the weight ratio of anionic surfactant to non-ionic antibacterial compound having a ClogP above 2 is below 300, preferably below 100 preferably below 30, for example below 10, or 5. For example the weight ratio of anionic surfactant to non-ionic antibacterial compound having a ClogP above 2 is between 8 and 200, for example between 20 and 80.

Preferably the weight ratio of cationic surfactant to non-ionic antibacterial compound having a ClogP above 2 is below 300, preferably below 100 preferably below 30, for example below 10, or 5. For example the weight ratio of cationic surfactant to non-ionic antibacterial compound having a ClogP above 2 is between 8 and 200, for example between 20 and 80.

Preferably the weight ratio of non-ionic surfactant to non-ionic antibacterial compound having a ClogP above 2 is below 300, preferably below 100 preferably below 30, for example below 10, or 5. For example the weight ratio of non-ionic surfactant to non-ionic antibacterial compound having a ClogP above 2 is between 8 and 200, for example between 20 and 80.

Adjunct Ingredients:

The aqueous fabric care composition may comprise adjunct ingredients. The ingredients may include dispersing agent, stabilizer, pH control agent, metal ion control agent, colorant, brightener, dye, odor control agent, pro-perfume, cyclodextrin, solvent, soil release polymer, preservative, antimicrobial agent, chlorine scavenger, enzyme, antishrinkage agent, fabric crisping agent, spotting agent, anti-oxidant, anti-corrosion agent, bodying agent, drape and form control agent, smoothness agent, static control agent, wrinkle control agent, sanitization agent, disinfecting agent, germ control agent, mold control agent, mildew control agent, antiviral agent, drying agent, stain resistance agent, soil release agent, malodor control agent, fabric refreshing agent, chlorine bleach odor control agent, dye fixative, dye transfer inhibitor, color maintenance agent, color restoration/rejuvenation agent, anti-fading agent, whiteness enhancer, anti-abrasion agent, wear resistance agent, fabric integrity agent, anti-wear agent, rinse aid, UV protection agent, sun fade inhibitor, insect repellent, anti-allergenic agent, flame retardant, water proofing agent, fabric comfort agent, water conditioning agent, stretch resistance agent, cationic starch, and combinations thereof. Each adjunct ingredient may be present in an amount of for example from 0.01 to 3% by weight of the composition. The aqueous fabric care composition may comprise an antibacterial agent. The composition may be free or essentially free of some or all of the above mentioned adjunct ingredient. The composition may be free or essentially free of phosphate builders, such as sodium tripolyphosphate. The composition may be free or essentially free of gums such as carbomethoxycellulose or succinoglycan polysaccharide.

The composition of the invention may have a pH of from about 2 to about 5, preferably from about 2 to about 4.5, and more preferably from about 2.5 to about 4. In another embodiment, the composition may have a pH from about 5 to about 9, alternatively from 5.1 to about 6, alternatively from about 6 to about 8, alternatively from about 7.

Preferably the aqueous composition does not comprise or comprise a limited amount of fat and compounds that comprise nitrogen.

In one embodiment, the composition of the invention does not comprise, or comprise a low level of nitrogen comprising material, for example from 0 to 5% or from 0 to 3% or from 0 to 1% or from 0 to 0.1% by weight of nitrogen comprising material.

The composition of the invention preferably does not comprise, or comprise a low level of urea comprising material, for example from 0 to 5% or from 0 to 3% or from 0 to 1% or from 0 to 0.1% of urea.

The composition of the invention preferably does not comprise, or comprise a low level of softening oils, which include but are not limited to, vegetable oils (such as soybean, sunflower, and canola), hydrocarbon based oils (natural and synthetic petroleum lubricants, in one aspect polyolefins, isoparaffins, and cyclic paraffins), triolein, fatty esters, fatty alcohols, fatty amines, fatty amides, and fatty ester amines. For example the composition of the invention comprises from 0 to 5% or from 0 to 3% or from 0 to 1% or from 0 to 0.1% by weight of softening oils, triolein, fatty esters, fatty alcohols, fatty amines, fatty amides, and fatty ester amines. For example the composition of the invention comprises from 0 to 5% or from 0 to 3% or from 0 to 1% or from 0 to 0.1% by weight of softening oils. For example the composition of the invention comprises from 0 to 5% or from 0 to 3% or from 0 to 1% or from 0 to 0.1% by weight of fatty alcohols.

The composition of the invention may comprise from 0 to 5% or from 0 to 3% or from 0 to 1% or from 0 to 0.1% by weight of clay.

The composition of the invention may comprise from 0 to 5% or from 0 to 3% or from 0 to 1% or from 0 to 0.1% by weight of glycerol and/or polyglycerol ester.

The composition of the invention preferably does not comprise amines, or comprise a low level of amine, for example from 0 to 5% or from 0 to 3% or from 0 to 1% or from 0 to 0.1% by weight of amines. Amines include but are not limited to, materials selected from the group consisting of esteramines, amidoamines, imidazoline amines, alkyl amines, amdioester amines and mixtures thereof. Ester amines include but are not limited to, materials selected from the group consisting of monoester amines, diester amines, triester amines and mixtures thereof.

The invention also concerned the use of a composition of the invention to rinse or treat a fabric. In one embodiment, the invention concerns a process to clean and rinse a fabric comprising the steps of:

cleaning a fabric with a wash liquor comprising an anionic surfactant, rinsing the cleaned fabric with an aqueous liquor comprising the aqueous fabric care composition of the invention.

The process of the invention may be used in an automatic laundry machine or hand washing laundry basin(s). The process is particularly suitable to be used in a hand washing process. See e.g., U. S. Pat. Appl. No. 2003-0060390 A1. The cleaning step and the rinsing step may happen in the same bath, i.e. the aqueous fabric care composition is added to the wash liquor. Typically, the cleaning step and the rinsing step happen in two different baths. The fabric is removed from the wash liquor and introduced either in water into which is then added the aqueous fabric care composition or to another bath comprising an aqueous liquor comprising water and the aqueous fabric care composition.

The composition of the invention may allow to reduce the volume of water consumed in a rinse process.

EXAMPLES

Example 1 Aqueous Fabric Care Compositions

| | Weight percent of the composition | | | | | | |
|---|---|---|---|---|---|---|---|
| Ingredient | Ex 1A | Ex 1B * | Ex 1C | Ex 1D | Ex 1E | Ex 1F | Ex 1G |
| Cationic Surfactant (DEEDMAC) | 0 | 8.00 | 1 | 0 | 1 | 0 | 1 |

-continued

| Ingredient | Weight percent of the composition | | | | | | |
|---|---|---|---|---|---|---|---|
| | Ex 1A | Ex 1B * | Ex 1C | Ex 1D | Ex 1E | Ex 1F | Ex 1G |
| Thickener (Rheovis CDE ®) | 0.30 | 0.30 | 0.5 | 0.1 | 0.1 | 0.5 | 0.2 |
| Silicone Antifoam (PDMS) | 0.10 | 0.10 | 0.1 | 0.2 | 1.5 | 0.3 | 0.8 |
| Non ionic surfactant (Genapol T680 ® and/or Tween 20 ®) | | | 0.7 | 0.9 | 3 | 0.75 | 0.25 |
| Antibacterial compound (Tinosan HP100) | | | | 0.06 | | 0.03 | |
| Perfume microcapsules | 0.50 | 0.50 | 1.20 | 1.0 | 0.3 | 0.5 | 0.5 |
| Free Perfume | | | | 0.3 | 1.20 | 0.6 | 0.8 |
| Minors (dye, pH regulator, preservatives, chelant, $CaCl_2$ . . .) | 0.16 | 0.16 | 0.16 | 0.16 | 0.16 | 0.16 | 0.16 |
| Demineralised Water | 98.94 | 90.94 | balance | balance | balance | balance | balance |

* Comparative Example

The compositions are prepared by mixing the ingredients in water at room temperature.

In examples 1A and 1B, the perfume microcapsules comprise a perfume mixture comprising more than 80% of the perfume raw materials selected from eucalyptol, linalool, tetrahydro linalool, alpha-ionone, and gamma methyl ionone. The ClogP of Eucalyptol is 2.75 and its boiling point 176.3° C. Linalool has a ClogP of 2.54 and a Boiling point of 192.8° C. tetrahydro linalool has a ClogP of 3.51 and a Boiling point of 202° C. Alpha-ionone has a ClogP of 3.71 and a Boiling point of 268.08° C. Gamma methyl ionone has a ClogP of 4.01 and a Boiling point of 214.7° C. The shell of the microcapsule is of melanine formaldehyde.

In example 1D and 1F the antibacterial compound is premixed with the free perfume before mixing with the other ingredients.

Example 2 Smell Character of Fabric Rinsed with a Fresh Composition, and Aged Compositions 1A and 1B A sample of composition 1A and a sample of composition 1B are prepared. The samples are kept at 50° C. for 2 weeks to simulate an aged composition.

Two dried terry towels of 30 cm×30 cm which had been pre-conditioned with a composition comprising anionic surfactant are added in a beaker with 2 g the aqueous fabric care composition of either example 1A aged or example 1B aged in 11 of regular tap water at 25° C.

The fabrics are rinsed and stirred during 5 minutes in the beaker. The fabrics are spun dry by using a spin cycle in an automatic washing machine. After spinning, the fabrics are hung to dry for 24 hours.

The smell character of the fabric is compared with the smell of the fabric rinsed with a fresh composition (kept at 4° C. for 2 weeks).

The smell character of the fabric rinsed with the fresh composition is fruity, herbal, and fresh. The smell character of fabric rinsed with the aged composition of the invention (1A) is also fruity, herbal, and fresh. On the other hand, the smell character of the fabric rinsed with the aged composition comprising a high percentage of cationic surfactant (1B) is grassy and has a terpene smell.

Example 3 Leakage of the Perfume Micro-Capsules

The qualitative data concerning the character switch of the perfume in example 2 are corroborated with the leakage analysis of the perfume micro-capsules.

Two samples of composition 1A and two samples of composition 1B are prepared. One of the samples for each composition is kept at 50° C. for 2 weeks to simulate an aged composition. The other samples are kept at 4° C. for 2 weeks to simulate a fresh composition.

The perfume micro-capsules of the fresh and aged compositions 1A and 1B are extracted and then dissolved. The concentration of the 5 main perfume raw materials (eucalyptol, linalool, tetrahydro linalool, alpha-ionone, gamma methyl ionone) is measured via GCMS.

For each perfume pair (e.g. eucalyptol and linalool), the relative concentration between the two perfume raw materials in the perfume micro-capsules in the aged compositions 1A or 1B is compared with the relative concentration in the perfume micro-capsules in the aged compositions 1A or 1B.

For example, the relative concentration [eucalyptol]/[linalool] is calculated in the micro-capsules of the fresh composition 1A and in the micro-capsules of the aged composition 1A. Then, the ratio ([eucalyptol]/[linalool] in the aged capsules)/([eucalyptol]/[linalool] in the fresh capsules) is calculated.

If the relative concentrations between the perfume raw materials in the micro-capsules are relatively constant over time, then the calculated ratio is close to 1 which means that the perfume character does not significantly change overtime in the micro-capsules.

On the other hand if the relative concentrations between the perfume raw materials in the aged micro-capsules are quite different from the relative concentration between the perfume raw materials in the fresh micro-capsules, then the calculated ratio is quite different from 1 which characterizes a significant perfume character change during the aging of the microcapsules.

Ratio ([PRM1] in aged composition 1B)/([PRM2] in aged composition 1B)/([PRM1] in the fresh composition 1B)/([PRM2] in the fresh composition 1B).

| PRM1 | PRM2 | | | | |
|---|---|---|---|---|---|
| | eucalyptol | linalool | tetrahydro linalool | alpha-ionone | gamma methyl ionone |
| eucalyptol | 1 | 8.7 | 1.8 | 0.7 | 0.6 |
| linalool | 0.1 | 1 | 0.2 | 0.1 | 0.1 |
| tetrahydro linalool | 0.6 | 4.8 | 1 | 0.4 | 0.3 |
| alpha-ionone | 1.5 | 12.8 | 2.7 | 1 | 0.92 |

-continued

| | PRM2 | | | | |
|---|---|---|---|---|---|
| PRM1 | eucalyptol | linalool | tetrahydro linalool | alpha-ionone | gamma methyl ionone |
| gamma methyl ionone | 1.6 | 14.0 | 2.9 | 1.1 | 1 |

Average of the ratio above 1=5.2

Average of the ratio below 1=0.4

Ratio ([PRM1] in aged composition 1A)/([PRM2] in aged composition 1A)/([PRM1] in fresh composition 1A)/([PRM2] in fresh composition 1A).

| | PRM2 | | | | |
|---|---|---|---|---|---|
| PRM1 | eucalyptol | linalool | tetrahydro linalool | alpha-ionone | gamma methyl ionone |
| eucalyptol | 1 | 1.3 | 1.0 | 1.0 | 1.0 |
| linalool | 0.8 | 1 | 0.8 | 0.8 | 0.8 |
| tetrahydro linalool | 1.0 | 1.3 | 1 | 1.0 | 1.0 |
| alpha-ionone | 1.0 | 1.3 | 1.0 | 1 | 1.0 |
| gamma methyl ionone | 1.0 | 1.3 | 1.0 | 1.0 | 1 |

Average of the ratio above 1=0.92

Average of the ratio below 1=1.12

As shown above, the ratios are much closer to 1 when using the composition of the invention. That means that the perfume raw materials leak more uniformly in the composition of the invention. This leads to a better maintenance of the balance between the perfume raw materials and thus of the perfume character. Therefore the consumer will experience a more similar smell character when using the composition of the invention fresh or aged.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm".

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aqueous fabric care composition, having Brookfield viscosity at 60 rpm at 21° C. between 25 cp and 1000 cp, said composition comprising:

a) from about 0 wt % to about 3 wt % of anionic surfactant, b) from about 0 wt % to about 1.5 wt % of cationic surfactant, c) from about 0 wt % to about 2 wt % of a non-ionic surfactant, d) from about 0.01 wt % to about 15 wt % of perfume micro-capsules, said perfume micro-capsules comprising a perfume mixture of at least 3 perfume raw materials and wherein the perfume mixture comprises at least about 50 wt % of perfume raw material having a ClogP above about 3, e) from about 50 wt % to about 99.99 wt % of water said composition having a surfactant to perfume micro-capsule ratio of 2.5 or less and greater than zero.

2. The aqueous fabric care composition according to claim 1, wherein the composition comprises from about 0 wt % to about 1.5 wt % of anionic surfactant, from about 0 wt % to about 1.5 wt % of cationic surfactant, from about 0 wt % to about 2 wt % of a non-ionic surfactant, from about 0.02 wt % to about 2 wt % of perfume micro-capsules, and from about 60 wt % to about 99.9 wt % of water.

3. The aqueous fabric care composition according to claim 1, wherein the weight ratio of surfactant to perfume micro-capsule is below 1.

4. The aqueous fabric care composition according to claim 1, wherein the composition has a Brookfield viscosity at about 21° C. at about 60 rpm between 40 cp and 500 cp.

5. The aqueous fabric care composition according to claim 1, wherein the composition comprises a polymeric thickener.

6. The aqueous fabric care composition according to claim 1, wherein the composition comprises an antibacterial compound.

7. A package comprising the aqueous fabric care composition according to claim 1, wherein the package is a bottle or a sachet.

8. A composition according to claim 1, comprising an ingredient selected from the group consisting of dispersing agent, stabilizer, pH control agent, metal ion control agent, colorant, brightener, dye, odor control agent, pro-perfume, cyclodextrin, solvent, soil release polymer, preservative, antimicrobial agent, chlorine scavenger, enzyme, antishrinkage agent, fabric crisping agent, spotting agent, anti-oxidant, anti-corrosion agent, bodying agent, drape and form control agent, smoothness agent, static control agent, wrinkle control agent, sanitization agent, disinfecting agent, germ control agent, mold control agent, mildew control agent, antiviral agent, drying agent, stain resistance agent, soil release agent, malodor control agent, fabric refreshing agent, chlorine bleach odor control agent, dye fixative, dye transfer inhibitor, color maintenance agent, color restoration/rejuvenation agent, anti-fading agent, whiteness enhancer, anti-abrasion agent, wear resistance agent, fabric integrity agent, anti-wear agent, rinse aid, UV protection agent, sun fade inhibitor, insect repellent, anti-allergenic agent, flame retardant, water proofing agent, fabric comfort agent, water conditioning agent, stretch resistance agent, cationic starch and mixtures thereof.

9. A composition according to claim 1, comprising a dye.

10. An aqueous fabric care composition having a pH of from about 2 to about 5, and having Brookfield viscosity at 60 rpm at 21° C. between 25 cp and 1000 cp, said composition, said composition comprising:

a) from about 0 wt % to about 3 wt % of anionic surfactant,
b) from about 0 wt % to about 1.5 wt % of cationic surfactant,
c) from about 0 wt % to about 2 wt % of a non-ionic surfactant,
d) from about 0.01 wt % to about 15 wt % of perfume micro-capsules,
e) from about 50 wt % to about 99.99 wt % of water said composition having a surfactant to perfume micro-capsule ratio of 2.5 or less greater than zero.

11. The aqueous fabric care composition according to claim 10, wherein the composition comprises from about 0 wt % to about 1.5 wt % of anionic surfactant, from about 0 wt % to about 1.5 wt % of cationic surfactant, from about 0 wt % to about 2 wt % of a non-ionic surfactant, from about 0.02 wt % to about 2 wt % of perfume micro-capsules, and from about 60 wt % to about 99.9 wt % of water.

12. The aqueous fabric care composition according to claim 10, wherein the weight ratio of surfactant to perfume micro-capsule is below 1.

13. The aqueous fabric care composition according to claim 10, wherein the composition has a Brookfield viscosity at about 21° C. at about 60 rpm between 60 cp and 300 cp.

14. The aqueous fabric care composition according to claim 10, wherein the perfume micro-capsules comprise perfume mixture of at least 3 perfume raw materials and wherein the perfume mixture comprises at least about 50 wt % of perfume raw material having a ClogP above about 3.

15. The aqueous fabric care composition according to claim 10, wherein the composition comprises a polymeric thickener.

16. The aqueous fabric care composition according to claim 10, wherein the composition comprises an antibacterial compound.

17. A package comprising the aqueous fabric care composition according to claim 10, wherein the package is a bottle or a sachet.

18. A composition according to claim 10, comprising an ingredient selected from the group consisting of dispersing agent, stabilizer, pH control agent, metal ion control agent, colorant, brightener, dye, odor control agent, pro-perfume, cyclodextrin, solvent, soil release polymer, preservative, antimicrobial agent, chlorine scavenger, enzyme, antishrinkage agent, fabric crisping agent, spotting agent, anti-oxidant, anticorrosion agent, bodying agent, drape and form control agent, smoothness agent, static control agent, wrinkle control agent, sanitization agent, disinfecting agent, germ control agent, mold control agent, mildew control agent, antiviral agent, drying agent, stain resistance agent, soil release agent, malodor control agent, fabric refreshing agent, chlorine bleach odor control agent, dye fixative, dye transfer inhibitor, color maintenance agent, color restoration/rejuvenation agent, anti-fading agent, whiteness enhancer, anti-abrasion agent, wear resistance agent, fabric integrity agent, anti-wear agent, rinse aid, UV protection agent, sun fade inhibitor, insect repellent, anti-allergenic agent, flame retardant, water proofing agent, fabric comfort agent, water conditioning agent, stretch resistance agent, cationic starch and mixtures thereof.

19. A composition according to claim 10, comprising a dye.

* * * * *